US008082596B2

(12) United States Patent
Pohr et al.

(10) Patent No.: US 8,082,596 B2
(45) Date of Patent: Dec. 27, 2011

(54) GARMENT FOR PERSONAL AIR-CONDITIONING

(75) Inventors: Sebastian Heinz Pohr, Rosstal (DE); Alfred Vogler, Nuremberg (DE)

(73) Assignee: Entrak Energie-und Antriebstechnik GmbH & Co. KG, Wendelstein (DE)

( * ) Notice: Subject to any disclaimer, the term of this patent is extended or adjusted under 35 U.S.C. 154(b) by 264 days.

(21) Appl. No.: 12/518,534

(22) PCT Filed: Nov. 14, 2007

(86) PCT No.: PCT/EP2007/010986

§ 371 (c)(1),
(2), (4) Date: Jun. 10, 2009

(87) PCT Pub. No.: WO2008/074440

PCT Pub. Date: Jun. 26, 2008

(65) Prior Publication Data

US 2010/0242147 A1 Sep. 30, 2010

(30) Foreign Application Priority Data

Dec. 20, 2006 (DE) ..... 10 2006 060 990

(51) Int. Cl.
*A41D 27/02* (2006.01)
*A41D 27/28* (2006.01)
*A41D 13/002* (2006.01)

(52) U.S. Cl. ..... 2/97; 2/69; 2/81; 2/82; 2/102; 2/108

(58) Field of Classification Search ..... None
See application file for complete search history.

(56) References Cited

U.S. PATENT DOCUMENTS

| | | | | |
|---|---|---|---|---|
| 2,994,089 | A * | 8/1961 | Ferguson, Jr. et al. | 2/81 |
| 3,292,179 | A * | 12/1966 | Iacono, Jr. et al. | 2/457 |
| 3,710,395 | A * | 1/1973 | Spano et al. | 2/78.1 |
| 4,034,417 | A * | 7/1977 | Ellis | 2/81 |
| 4,208,383 | A * | 6/1980 | Kisters et al. | 423/215.5 |
| 4,229,411 | A * | 10/1980 | Kisters et al. | 422/62 |
| 4,242,769 | A * | 1/1981 | Rayfield et al. | 441/91 |
| 6,854,130 | B2 * | 2/2005 | van der Sleesen | 2/69 |
| 7,080,412 | B2 * | 7/2006 | Zeiler | 2/4 |
| 7,120,938 | B2 * | 10/2006 | Ichigaya | 2/272 |
| 39,295 | A1 * | 1/2007 | Sawicki et al. | 2/69 |
| 7,310,824 | B2 * | 12/2007 | Walsh | 2/122 |
| 7,735,149 | B2 * | 6/2010 | Jarvis | 2/69 |
| 7,854,017 | B2 * | 12/2010 | Laton | 2/81 |
| 2001/0000849 | A1 * | 5/2001 | Siman-Tov et al. | 62/259.3 |
| 2002/0016984 | A1 * | 2/2002 | Poholski | 2/94 |

(Continued)

FOREIGN PATENT DOCUMENTS

DE 10 2004 002287 A 8/2005

(Continued)

*Primary Examiner* — Bobby Muromoto, Jr.
(74) *Attorney, Agent, or Firm* — Lucas & Mercanti, LLP

(57) ABSTRACT

An item of clothing for personal air-conditioning which has at least one three-dimensional air-flow guiding structure. The air-flow guiding structure is an air-impermeable woven spacing fabric. At least one pocket exists to accommodate an air-pumping device. The pocket interior is connected to the structure which allows for an air-flow capable of being supplied by the air-pumping device into the structure or out of the structure and connected to the environment allowing air to be drawn from or expelled into the environment.

18 Claims, 2 Drawing Sheets

U.S. PATENT DOCUMENTS

| | | | | |
|---|---|---|---|---|
| 2003/0033656 | A1* | 2/2003 | Jaeger | 2/69 |
| 2005/0034476 | A1* | 2/2005 | Pohr | 62/420 |
| 2005/0278817 | A1* | 12/2005 | Doheny | 2/69 |
| 2006/0048263 | A1* | 3/2006 | Walsh | 2/69 |
| 2006/0080987 | A1* | 4/2006 | Ichigaya | 62/259.3 |
| 2006/0107679 | A1* | 5/2006 | Pohr et al. | 62/259.3 |
| 2007/0094762 | A1* | 5/2007 | Carter et al. | 2/69 |
| 2007/0094763 | A1* | 5/2007 | Silver | 2/69 |
| 2007/0118956 | A1* | 5/2007 | Sawicki et al. | 2/69 |
| 2008/0060113 | A1* | 3/2008 | Walsh | 2/116 |
| 2008/0216205 | A1* | 9/2008 | Conley et al. | 2/82 |
| 2009/0019624 | A1* | 1/2009 | Birk et al. | 2/455 |
| 2010/0083417 | A1* | 4/2010 | Alder et al. | 2/69 |
| 2010/0242149 | A1* | 9/2010 | Mickle et al. | 2/82 |

FOREIGN PATENT DOCUMENTS

| | | |
|---|---|---|
| DE | 10 2005 010951 | 9/2006 |
| EP | 0 490 347 | 6/1992 |
| EP | 1 552 759 | 7/2005 |
| EP | 1 698 242 A | 9/2006 |

* cited by examiner

GARMENT FOR PERSONAL AIR-CONDITIONING

This application is a 371 of PCT/EP2007/010986 filed Dec. 14, 2007, which in turn claims the priority of DE 10 2006 060 990.5 filed Dec. 20, 2006, the priority of both applications is hereby claimed and both applications are incorporated by reference herein.

The invention relates to an item of clothing for personal air-conditioning at least partially consisting of or provided with at least one three-dimensional air-flow guiding structure, in particular, an air-permeable woven spacing fabric.

An item of clothing of this kind is known, for example, from DE 10 2004 002 287 A1. It provides at least one air-permeable woven spacing fabric, consisting of an outer and an inner layer, which are distanced from one another via a plurality of fibres made of a relatively-rigid fibre material extending between them, so that a sufficiently stable, air-permeable woven layer is provided between the layers. The outer layer can be per se air-impermeable, while the inner layer is air-permeable at least in regions or over its entire surface area. Alternatively, the outer layer can also be air-permeable at least in regions, wherein a further, external air-impermeable layer, which forms, for example, the outer material of the item of clothing, is provided for sealing relative to the outside. The use of an air-permeable woven fabric of this kind allows air to be guided between these layers, which is subject to turbulence on its path through the fibres and is consequently distributed over the entire area between the two layers. As a result of the air-permeability of the inner layer, air can now either be blown in a targeted manner into the air-flow guiding structure, which then emerges through the inner layer, which is associated with the person's body, and ventilates the latter. Alternatively, it is conceivable to draw air from the layer thereby drawing warm and sweat-laden air from the proximity of the body via the inner layer into the air-flow guiding structure and removing it from the latter. For this purpose, a connecting means in the form of a special connecting tube or similar, to which an air-pumping device should be connected manually, is provided in the case of the item of clothing known from DE 10 2204 002 287.

With an item of clothing of this kind, a good personal air-conditioning can, in principle, be achieved. Accordingly, it is possible to work even during heavy physical exertion. Conceivable applications include, for example, the fields of the fire service, guarding or personal security services but also in the military sector, in fact, anywhere, where heavy physical work is required for considerable periods of time in potentially uncomfortable surroundings. A use in sporting or leisure activities is also conceivable. However, during the manual connection of the personal air-conditioning device to the connecting tubes, difficulties can occur, especially since this is often performed while wearing gloves, which restrict the manipulation of the connections, which are normally relatively small. For example, either the gloves have to be removed, if this is at all possible, or the assistance of another person is required. Moreover, the additional, awkward attachment of a special connection means, for example, in the form of a connecting tube or a connecting flange is required. Furthermore, the cleaning of the item of clothing is more difficult, because the connection means must optionally be removed in this context in order to clean this region. The invention is therefore based upon the problem of specifying a simply structured item of clothing, which allows a simplified coupling of an air-pumping device used for personal air-conditioning, that is to say, for transporting the air.

By way of solution to this problem, with an item of clothing of the type named in the introduction, according to the invention, at least one pocket is provided for the accommodation of an air-pumping device, wherein the pocket interior is connected to the structure in a manner allowing a flow of air capable of being supplied by the air-pumping device into the structure or from the structure and connected to the environment in a manner allowing air to be drawn from or expelled into the environment.

With the item of clothing according to the invention, no special connecting tubes or other connecting elements, which must be connected in an awkward, flow-guiding manner to the air-pumping device, are required. On the contrary, the item of clothing according to the invention is characterised by a simple pocket, which accommodates an air-pumping device. The pocket interior is connected at one end to the structure, and, at the other end, to the environment. This allows air to be blown by means of the air-pumping device via a corresponding air-flow opening either from the environment into the pocket interior and from there via a second air-flow opening into the structure and from there out towards the body, or, in reverse operation, to allow air to be drawn via the air-pumping device outwards from the structure, away from the body and out into the environment via the corresponding air-flow opening. With regard to handling, the fitting of the air-pumping device is very straightforward; it must simply been inserted into the pockets, after which the corresponding fluid coupling of the air-pumping device to the environment and to the interior of the structure is provided directly, that is to say, the air-pumping and therefore also the cooling operation can therefore be started immediately. For this purpose, the use of a personal air-conditioning device of the smallest possible format, as known, for example, from DE 10 2005 010 951 A1, is particularly expedient. This small-format air-pumping device is very simple to handle, the pocket can be kept relatively small with a sufficiently large air-pumping volume and therefore output performance. The air-pumping device is completely autonomous in operation, and therefore provides an integrated power supply etc. The provision of several pockets, in each of which one such air-pumping device can be fitted in order to supply or extract air at two or more different positions, is, of course, also conceivable.

The air-flow guiding structure can once again be a woven spacing fabric, consisting of an inner and outer layer, connected via corresponding, stable fibres, wherein both layers are preferably air-permeable, and the outer layer is covered externally by a further air-impermeable layer, wherein this air-impermeable layer can be connected loosely or firmly to the outer layer of the woven spacing fabric. As an alternative to a woven spacing fabric of this kind, any other three-dimensional fine structure can also be used, which creates a spacing between the wearer's clothing and the outer layer or the outer material of the item of clothing, in order to realise an open, air-conveying structure, for example, a textile layer with nubs or similar. In every case, this structure preferably forms the lining of the item of clothing, which is preferably worn over the wearer's other clothing or equipment and, as a result of the stability of the structure, is only slightly compressed, so that the airflow can be maintained continuously. The flow cavity is ultimately limited either by the airtight outer layer or the airtight outer material acting as a seal relative to the outside. Accordingly, with an item of clothing of this kind, it is possible to remove warm or sweat-laden, moist air from the surface of the body and replace it with fresh ambient air. Accordingly, the item of clothing according to the invention supports the body's own thermo-regulation system, in which a build-up of moisture is avoided, and evaporative cooling through the drying of sweat is allowed. Evaporative cooling is highly efficient and also effective at ambient temperatures, which are disposed above body temperature.

The pocket itself is expediently attached to the air-impermeable layer, which covers the structure externally as the outer material or as the external component of the structure, and which is open in the pocket region thereby forming an air-flow opening towards the structure. Furthermore, the pocket provides an air-flow opening leading to the environment, and a closable opening, through which access can be gained to the interior of the pocket. Accordingly, the pocket is connected, for example, stitched or glued, to the external layer, in this context regardless of whether this is directly the external layer of the structure or of the spacing fabric or a separate outer layer. This air-impermeable layer is cut away in regions, that is to say, opened, in order to form the air-flow opening, through which the air enters the structure or is extracted from the latter. The pocket is therefore open on the inside towards the structure. The exchange of air with the environment takes place via a further air-flow opening.

While the pocket according to the embodiment of the invention described can be firmly attached to the material or the layer, it is, in principle, also conceivable to attach the pocket to the item of clothing in a detachable manner, that is to say, to the external layer, wherein the pocket is closed on all sides apart from the air-flow opening and can be attached to the item of clothing in a detachable manner via fastening means. This allows the possibility of removing the pocket if it is not required, wherein a corresponding closure flap or similar can then optionally be attached to the item of clothing for the air-flow opening provided in the outer material. This means that the pocket is only attached if it is required. It is also possible to remove the air-pumping device together with the pocket, for example, in order to supply air in a targeted manner directly to the face. As fastening means for the detachable pocket, one or more zip fastener, one or more Velcro-typed fastener or one or more snap fastener can, for example, be provided.

As an alternative to the attachment of a pocket, it is conceivable that a sufficiently air-impermeable layer, which covers the structure on the outside or is an external component of the structure, forms the outer skin of the pocket, wherein the interior of the pocket is accessible via a closable opening. In this context, the pocket is therefore provided internally, that is to say, the air-impermeable layer forms the pocket itself, the latter is disposed below this external layer. Once again, access is gained to the interior of the pocket through a corresponding opening in the layer, which can be closed, for example, via a zip fastener or similar. Here also, the interior of the pocket communicates via an internal air-flow opening with the structure, and via an external air-flow opening with the environment.

The air-flow opening leading to the environment is expediently provided at the lower end of the pocket, that is to say, when drawing air from the structure, the air-pumping device blows downwards from the pocket or draws air in from below. This can be useful, for example, for reasons of acoustics, because the operating noise of the air-pumping device can be radiated away from the ear in this manner. Weather protection is also achieved in this manner. The air-pumping device cannot become wet, for example, in the event of rain. Dependent upon the embodiment or the purpose of use, however, an orientation of this air-flow opening to the side or upwards is also conceivable. The air-flow opening leading to the environment is expediently closed with an open-mesh woven netting fabric.

As already described, it is, in principle, possible to provide several pockets on the item of clothing, in each of which, for example, one air-pumping device can be fitted. For instance, if two pockets are provided, and if only one is fitted with an air-pumping device, or if both are fitted with an air-pumping device, of which only one is operated, there would in principle be the possibility that air is drawn directly via the air-flow opening of the second pocket leading to the environment. This is disadvantageous especially if the two pockets are arranged relatively close to one another, so that the air-flow path is "short-circuited", and accordingly, the actual air transport to or from the body of the person is not achieved adequately. In order to prevent this, the air-flow opening of a pocket leading to the environment can expediently be closed in a reversible manner, for example, via a Velcro-typed fastener and an appropriate sealing portion, a zip fastener or similar. This means that the user can close an external air-flow opening, either if there is no air-pumping device in this pocket, or if an air-pumping device disposed therein is not currently in operation.

The opening of the pocket, through which the air-pumping device can be introduced into the pocket, can also expediently be closed via a zip fastener, via a Velcro-typed fastener or a snap fastener, that is to say, via sufficiently airtight closing means, which are relatively simple to handle.

The pocket itself expediently consists of a sufficiently air-impermeable material and provides a portion consisting of a transparent material, which allows visual access to the interior of the pocket. This allows display means of the air-pumping device to be recognised through this transparent portion; the device can optionally also be controlled through the latter, for example, by pressing control buttons or similar on the air-pumping device through this flexible transparent portion, for instance, in order to switch it on or off. However, this can also be implemented through a control opening leading into the interior of the pocket, through which the user can gain access to the interior of the pocket.

Since an albeit small operating noise is associated with an air-pumping device of this kind, which comprises a small electric motor with an associated fan, which can have a disturbing effect in various applications (a use of the item of clothing in the office to provide cooling during work is, of course, also conceivable), the pocket is expediently lined or respectively provides an insert at least in regions, in order to realise a damping of noise.

To prevent the access to the air-flow opening, which communicates with the flow-guiding structure, from being accidentally closed, for example, by the arm of the wearer, who has to carry, for example, a load etc., which prevents or obstructs an intake of air from the structure or a blowing of air into the structure, a supporting insert preventing the closure of the air-flow opening is expediently provided in the region of the air-flow opening leading to the structure. This supporting insert can, for example, be an narrowly dimensioned second layer of a woven spacing fabric or similar, but in fact, any device, which, in the event of a pressure on the pocket region from above, prevents the fluid communication between the interior of the pocket and the structure from being obstructed or closed.

The shape of the pocket or respectively of any insert disposed firmly within the latter is substantially adapted to the shape of an air-pumping device to be fitted, so that the latter is accommodated within the pocket as far as possible "without play", and the intake opening of the air-pumping device is necessarily disposed in the immediate proximity of the corresponding air-pumping opening of the pocket, and the output opening of the air-pumping device is also automatically positioned during fitting in the immediate proximity of the corresponding outlet air-flow opening. The fitting of the air-pumping device with the minimum possible play prevents an undesirable back-flow into the pocket between the intake and the outlet opening of the air-pumping device. If an internal casing (for example, made of a relatively soft synthetic-material) or an internal lining (for example, a relatively thick woven fabric or similar) is provided, this can also provide a mechanical protection of the air-pumping device. If the air-pumping device is designed appropriately, it is even possible to fit the air-pumping device in a different orientation, because in such a case the air-flow direction is reversed simply by the operating control. If, in the one position of the air-pumping device, the intake opening is connected to the air-flow opening leading to the environment, and the output opening is connected to the air-flow opening leading to the structure via a fluid connection, air is blown into the structure and towards the body. If the air-pumping device is now inserted the other way round, the intake opening of the air-pumping device is connected to the air-flow opening leading to the structure, while the output opening is connected to the air-flow opening leading to the environment. In this case, air is drawn through the structure away from the body and expelled towards the outside. Regardless of how the air-pumping device is fitted into the pocket, the appropriate openings on the device are always connected to the corresponding air-flow openings.

As already described, the shape of the pocket is expediently designed substantially corresponding to the shape of an air-pumping device to be fitted. The air-pumping device is preferably substantially rectangular and relatively flat, so that it is not excessively bulky. Accordingly, the pocket, or an insert fitted within the latter, also provides a substantially rectangular interior shape. This is advantageous for several reasons. One central advantage is that after the insertion of the air-pumping device into the pocket, the former is automatically correctly positioned, that is to say, the intake and outlet opening of the air-pumping device are exactly positioned disposed adjacent to or opposite to the air-flow openings for the internal structure or to the environment. As a result of the fitting with minimal play, the air-pumping device is also prevented from slipping. Moreover, if the pocket is designed in such a manner, that the layer limiting the pocket or the insert is in contact in a sealing manner at least in the region of the air-flow openings with a fitted air device, a corresponding back flow is also prevented. That is to say, the pocket is dimensioned in such a manner that at least in the region of the intake and outlet openings of the air-pumping device, the pocket material is in contact with the housing of the air-pumping device in a sealing manner. As a result, a defined guiding of the air can be secured without the intake of secondary air or respectively without back flow. The layer is expediently disposed substantially over the full surface area of the air-pumping device, and indeed over its entire lateral surfaces, so that a very good, full-surface seal is provided at the same time as a secure fitting of the air-pumping device without the possibility of slipping. However, even a linear seal in the region of the air-flow opening is equally effective.

By way of further security that no secondary air is taken in, the opening can expediently be closed via substantially air-tight closing means, especially a sealing zip fastener or Velcro-type fastener. This prevents secondary air from being drawn in via the pocket opening, which is closed, for example, with a zip fastener after the fitting of the air-pumping device. This volume of air would accordingly not be drawn from the interior of the item of clothing; and would therefore not contribute to the air-conditioning of the wearer.

Furthermore, means for adjusting the width of the item of clothing can be provided. For example, a drawstring either at the lower end or in the region of the middle of the item of clothing, designed, for example, as a jacket or vest, is conceivable. The use of an expanding fabric-layer insert, which is disposed, for example, behind a zip fastener and is folded out when the zip fastener is opened, is also conceivable. For instance, in the chest region, adjacent to the arm holes, two zip fasteners of this kind can be provided to the left and the right backed with corresponding fabric-layer inserts.

Finally, as already described above, it is conceivable to attach a detachable pocket, for example, not only at a single position in the region of the lower end of the jacket or vest, as will be described in greater detail below, but, if required, also, for example, in the chest region or at the sides. For this purpose, corresponding fastening means, which define the alternative attachment positions, and, of course, also a corresponding air-flow opening, which leads to the interior structure, are provided on the item of clothing. When not in use, this air-flow opening is tightly sealed via a fabric-layer portion, so that no secondary air can be drawn in from there. If, as a result of the given situation, a pocket is to be fitted together with the air-pumping device, this fabric-layer portion must be removed, and the pocket must be attached to the corresponding fastening means (for example, snap fasteners, Velcro-typed fastener, zip fastener etc).

Further advantages, features and details of the invention are indicated in the exemplary embodiment described below and with reference to the drawings. The drawings are as follows.

Figure 1:
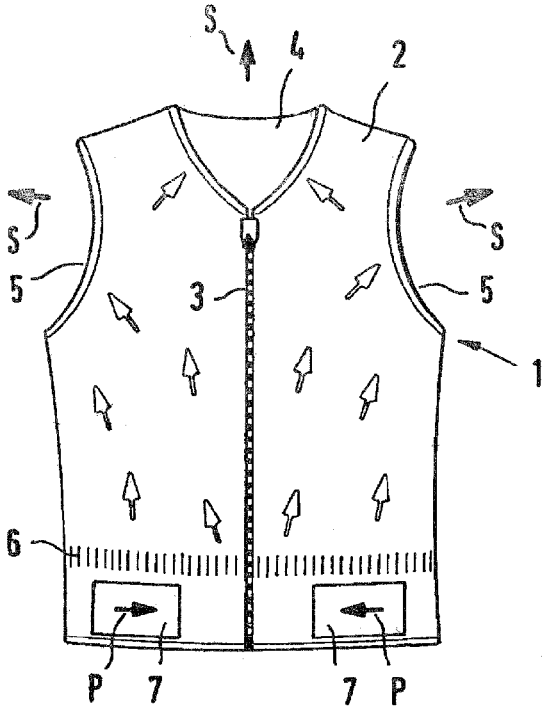
FIG. 1 shows a schematic presentation of an item of clothing according to the invention in the form of a vest according to a first exemplary embodiment.

FIG. 1 shows a schematic presentation of an item of clothing 1 according to the invention, in this case, for example, in the form of a vest 2, which can be opened in a known manner via a zip fastener 3 at the front in order to put it on and can then be closed. It provides a neck cut-out 4 and two arm cut-outs 5 and can be tightened in the region of the waist via at least one circumferential rubber band 6 or a drawstring. The vest 2 consists, for example, of a knitted spacing fabric, which forms the interior lining, and which is provided on the outside with an outer material made of air-impermeable material, which will be referred to in greater detail below in conjunction with FIGS. 3-6.

In the region of the lower end of the vest 2, two pockets 7 are provided, in each of which, as will also be explained in greater detail below, an air-pumping device can be fitted, which, in the illustrated example, draws air from the environment into the interior of the pocket, as illustrated by the arrows P, and blows air from the interior of the pocket into the interior of the air-flow guiding structure, in this case, for example, the woven spacing fabric. This woven spacing fabric is open towards the body, so that air blown towards the wearer's body can be expelled and can cool the latter, for example, by evaporative cooling via the drying of sweat etc.

As indicated by the arrows S, after flowing through the structure, the air flows out again in the region of the neck and arm cut-outs 4, 5.

Figure 2:
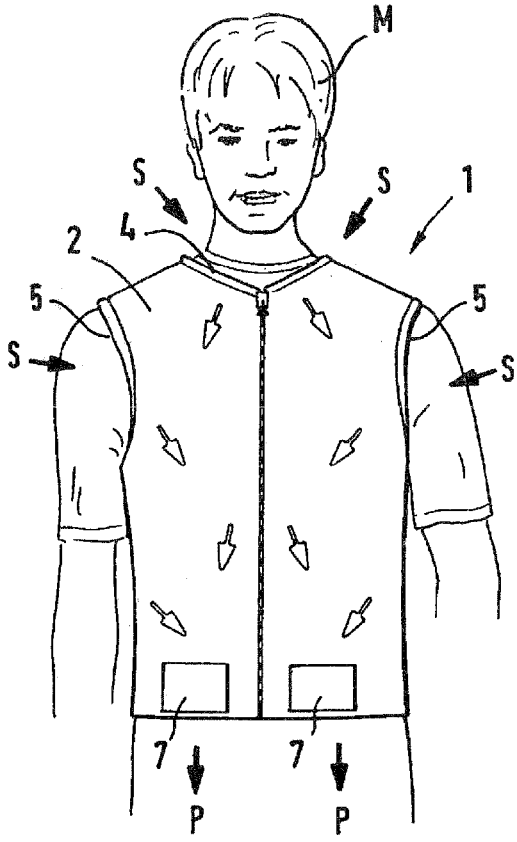
FIG. 2 shows a schematic presentation of an item of clothing according to the invention in the form of the vest according to a second exemplary embodiment.

While FIG. 1 shows an item of clothing 1 according to the invention in the form of a vest 2, in which air is blown from outside into the item of clothing, FIG. 2 shows a schematic presentation, in which air is drawn from the outside into the structure, flows through the latter and is then expelled again in the region of the pockets. Here also, two pockets 7 are provided, in each of which an air-pumping device is fitted. The latter now draws air from the interior of the woven spacing fabric, which air flows into the latter via the neck and arm cut-outs 4, 5, as illustrated by the arrows S. This air now flows through the woven spacing fabric and, in this context, takes up air warmed by the body of the person M or charged with moisture from sweat. This charged air is blown outwards into the environment in the region of the pockets 7, as indicated by the arrows P.

Figure 3:
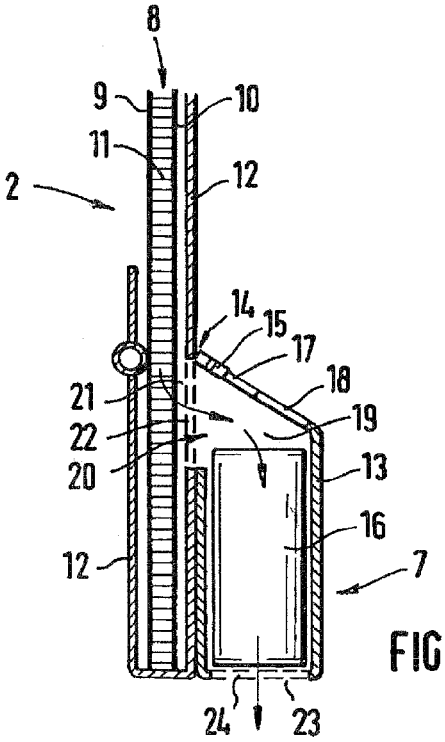
FIG. 3 shows a detail view of the item of clothing from FIG. 2 in the region of pocket.

In the form of a detailed schematic presentation, FIG. 3 shows a sectional view through the vest 2 from FIG. 2 in the region of a pocket 7. As described, the vest 2 consists of an internal structure 8, here in the form of a woven spacing fabric, comprising an internal layer 9 and an external layer 10, both of which are connected to one another via stable fibres 11 and disposed at a distance from one another. Accordingly, an air-flow structure is formed; air drawn or blown inwards circulates between the stable fibres 11. The latter are sufficiently stable to hold the two layers 9, 10 at a spacing distance and also to withstand a certain pressure, so that the structure 8 does not simply collapse, but remains open to flow.

The outer layer 10 is covered by a further sufficiently air-impermeable layer 12, which forms an outer material. This layer 12 extends up to the inside of the vest 2 in the lower region of the internal layer 9; and therefore also forms an internal airtight closure in the lower region of the vest.

The pocket 7, which also consists of a sufficiently air-impermeable material 13, is attached to this outer layer 10. The latter provides an opening 14, which can be opened and closed in a reversible manner, for example, with a zip fastener 15, in order to introduce the air-pumping device 16. Adjacent to this opening, there is, for example, a further opening 17, through which a control of the air-pumping device 16, for example, an on-off button, can be activated. Optionally, the pocket material also provides a transparent portion 18, through which the wearer can see into the interior of the pocket, for example, to inspect an illuminated display or similar of the air-pumping device 16.

In every case, the pocket interior 19 communicates via a first air-flow opening 20 with the flow-guiding structure 8. For this purpose, the outer material 12 provides an opening 21, which is closed, for example, with a net-like material 22, which is air permeable. Through this, air can be drawn from the structure 8 into the pocket interior 19. Furthermore, the pocket 7 provides a second air-flow opening 23 at the lower end, which is also closed in an air permeable manner with a net-like woven fabric 24. Air drawn in is expelled through this opening provided at the lower end of the pocket.

The shape of the pocket 7 is adapted to the shape of the air-pumping device. By preference, the latter is designed as a simple axial fan and provides the smallest possible small-format geometry. The pocket material 13 itself is preferably sewn or glued onto the outer material 12, and is therefore firmly connected. However, it would also be conceivable to arrange the latter in a detachable manner and accordingly to design the pocket 7 to be removable. Instead of the axial fan, a radial fan can also be used, wherein the positions of the air-flow openings are then selected according to the intake and outlet openings of the radial fan.

The drawings do not show in detail a supporting insert, which serves to prevent a closing of the "airlock", that is to say, of the region of the air-flow opening 20 leading towards the structure. This supporting insert can, for example, be a narrow portion of woven spacing fabric, which is sufficiently stable to hold open a flow pathway even under considerable loading. This supporting insert can be disposed, for example, on the inside of the pocket, so that the open structure of the knitted spacing fabric is pressed against the air-pumping device in the event of a loading on the pocket from above, and accordingly does not close its intake opening.

Figure 4:
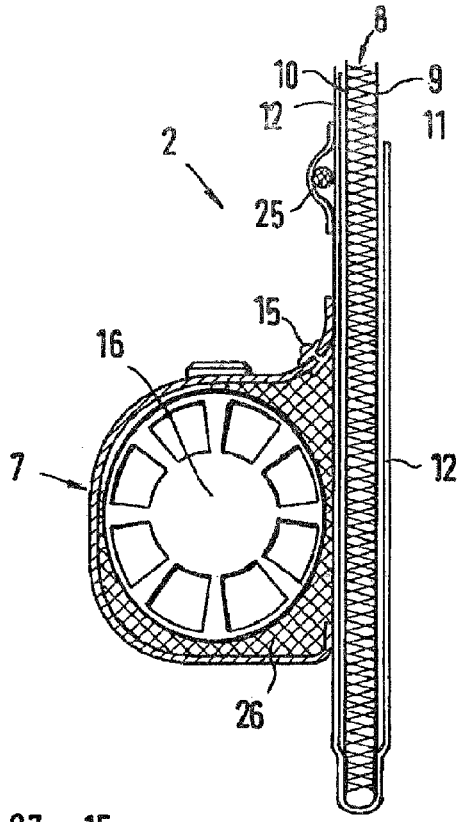
FIG. 4 shows a detail view of the item of clothing from FIG. 1 in the region of a pocket in a lateral view.
Figure 5:
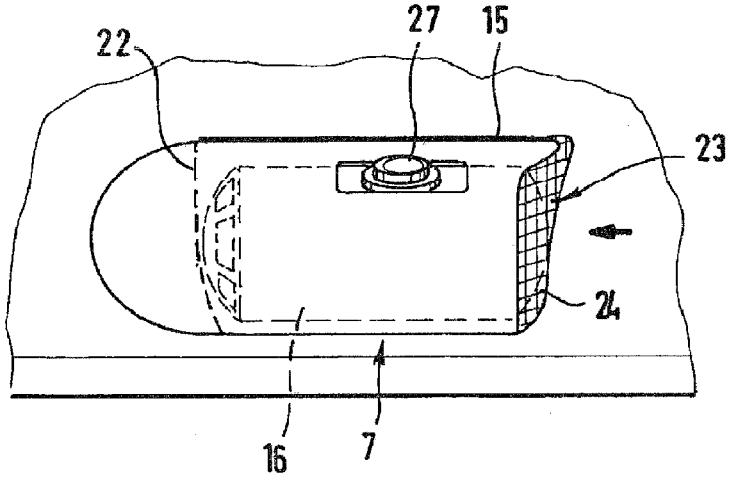
FIG. 5 shows the partial view from FIG. 4 in a frontal view.
Figure 6:
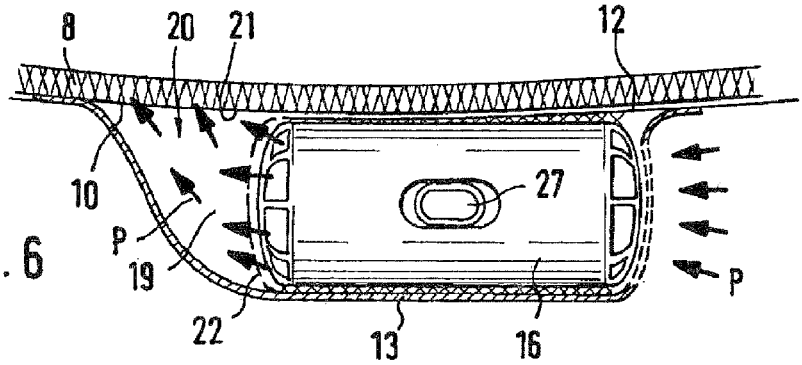
FIG. 6 shows the partial view from FIG. 4 in a view from above.

FIGS. 4-6 show a further embodiment of a pocket design, such as can be provided in an item of clothing 1 from FIG. 1. The vest 2 shown there also consists of a flow-guiding structure 8 in the form of a woven spacing fabric with an internal layer 9, an external layer 10 and stable fibres 11 holding the latter at a spacing distance. Once again, a sufficiently air-impermeable outer material 12 is provided on the outside, and in this context, a cord 25 is also shown, which allows improved adjustment for the wearer. Once again, the air-impermeable outer material 12 extends up to the inside of the internal layer 9 in order to form an airtight seal in the lower region of the vest. Here also, the pocket 7 is once again attached to the outer material 12 and connected firmly to the latter. With this embodiment of the invention, the air-pumping device 16 is disposed horizontally. The pocket 7 is provided with an internal casing 26, which is adapted to the substantially cylindrical form of the air-pumping device here, which can be referred to as the "ventilator cartridge", so that the latter is accommodated in a relatively form-fit manner in the interior of pocket. In order to gain access to the interior, a zip fastener 15 is once again provided on the upper side, through which the pocket can be opened.

With this embodiment of the invention, the air-pumping device 16 draws air from the environment, as indicated by the arrow P. For this purpose, an air-flow opening 23, which is also closed with an open-mesh netting fabric 24, is provided at the side of the pocket 7. Via a further air-flow opening 20, the pocket interior 19 communicates with the knitted spacing fabric, that is to say, the air-flow-guiding structure 8. For this purpose, the outer material 12 provides a corresponding opening 21, which allows access to the structure 8, so that air can be blown directly into the latter via the outer layer 10, which is air permeable, as indicated by the arrows P. The outer material 12 extends into the pocket interior; only in the region of the opening 21, is the outer material 12 removed, to allow the passage of air through this "airlock". Of course, another layer of knitted spacing fabric could also be provided here to act as a supporting layer and to prevent the air outlet of the air-pumping device 16 from being compressed, which is not illustrated in greater detail.

In order to allow as movement-free a fixing of the air-pumping device 16 as possible, the internal casing 26 is provided as described. This can be designed in conjunction with the pocket material 13 in such a manner that a control button 27, by means of which an operating control is possible, projects upwards. In the illustrated example, an open-mesh, woven netting fabric 22, which is air-permeable, but which prevents the air-pumping device 16 from being inserted any further, is provided in order to limit the insertion movement. On the one hand, a certain noise damping of the noise from the fan and the air-flow is provided, and on the other hand, an undesirable back flow between the intake and outlet opening of the air-pumping device is prevented via the internal casing.

As described, the item of clothing according to the invention, which can have any required shape (for example, vest, jacket, trousers, overall etc.) allows the integration and fluid coupling of an air-pumping device in a very simple manner in order to guide air away from or towards the wearer's body. The outer material, which, on the one side, provides a secure covering for the internal air flow, but which on the other side also provides the retainer or respectively the basis for attachment of the pocket, guarantees that the air does not escape to the outside. The outer material 12 must be airtight, lightweight and, in particular, sufficiently resistant to tearing. Moreover, the material should be water repellent, but at the same time permeable to vapour. In the lower region, it extends inwards as described and therefore forms a continuous internal skin. This is necessary so that the air blown in cannot escape downwards, but escapes in the region of the wearer's upper body. Accordingly, the internal skin must also be as airtight as possible, for which reason it preferably consists of the outer material. It is connected to the inner structure, that is to say, in this context, to the knitted spacing fabric. However, penetrating moisture, such as sweat or similar must be able to dry, for which reason the material should be vapour permeable, as described.

As already described, the item of clothing according to the invention, for example, in the form of a jacket or vest, offers an excellent possibility for the achievement of a convenient air-conditioning of the wearer in a particularly simple manner especially with regard to handling. The design according to the invention of the pocket allows the item of clothing to be made ready for operation rapidly and simply. All that is required is to insert the air-pumping device, which provides, for example, an integrated battery or power supply, into the pocket. As described, the shape of the pocket is, by particular preference, adapted to the shape of the air-pumping device, so that the latter is accommodated in the pocket firmly and with minimum play. At the same time, this ensures that the intake and outlet openings of the air-pumping device are positioned accurately and disposed opposite to the air-flow openings towards the internal structure and respectively towards the environment. All that remains is to close the pocket via the zip fastener or Velcro-typed fastener or similar (however, such a fastener is not even necessarily required, if a minimal-play or slightly pre-tensioned fitting of the air-pumping device in the pocket is ensured). As a result of this adaptation of shape, a seal is provided to prevent a short-circuited air-flow, that is to say, no back flow is permitted between the corresponding openings, since the pocket material is in close contact with the device housing. Also, with the use of airtight pocket closures, an intake of secondary air is prevented. The integration of a transparent window for any displays and/or for the operating controls of the air-pumping device is also allowed in a very convenient manner without the need to remove the air-pumping device for this purpose. Furthermore, good noise damping is provided by the pocket material or by the orientation of the outlet opening, which preferably faces downwards, but can if required also be directed backwards, to the side or upwards, dependent upon the purpose of use. The pocket also provides a certain mechanical protection for the fan unit, in particular, if a corresponding pre-formed pocket insert is provided. In principle, a reversal of the direction of flow is also possible. Moreover, the item of clothing according to the invention in the form of a jacket or vest in conjunction with the preferred orientation of the outlet opening in the downward direction, that is to say, towards the wearer's legs, provides the possibility of wearing this item of clothing beneath protective clothing, for example, a thermally-insulating overall (for example, for a furnace operator or firemen) or of another protective suit; for it can be ensured that this outer suit does not prevent the outlet of the air. However, the use of the item of clothing is not restricted to such extreme areas of application. On the contrary, the jacket or vest or similar can also be worn for leisure pursuits. In this context, if the jacket or vest is worn, for example, when driving, it is also possible to connect the air-conditioning device, for example, to the onboard power supply of the vehicle, for instance, via a connecting plug, for example, in order to charge the power packs integrated in the fan device or to operate the device directly by this means.

The invention claimed is:

1. An item of clothing for personal air-conditioning, comprising:

at least one three-dimensional air-flow guiding structure, wherein at least one pocket is provided for accommodation of an air-pumping device, and wherein the pocket has an interior connected to the structure allowing an air-flow capable of being supplied by the air-pumping device into the structure or out of the structure and connected to an environment allowing air to be drawn from or expelled into the environment, wherein the interior of the pocket is connected with the structure and the environment by air-flow openings, the pocket having an opening that is openable and closable in a reversible manner, wherein the air-pumping device is slideable into the pocket, the pocket being shaped so as to conform to a shape of the air-pumping device so that the air-pumping device is accommodated in the pocket substantially without play and so that an intake and an output opening of the air-pumping device are automatically positioned next to respective of the air-flow openings.

2. The item of clothing according to claim 1, wherein the pocket is attached to an air-impermeable layer, which covers an outside of the structure or is an external component of the structure, which is open in a region of the pocket thereby forming the air-flow opening to the structure, which provides the air-flow opening leading to the environment, and is accessible via a closable opening.

3. The item of clothing according to claim 2, wherein the pocket is closed on all sides apart from the air-flow openings and is attachable to the item of clothing in a detachable manner via fastening means.

4. The item of clothing according to claim 3, wherein fastening means in the form of one or more zip fasteners, one or more hook and loop fasteners or one or more snap fasteners are provided.

5. The item of clothing according to claim 1, wherein an air-impermeable laver, which covers an outside of the structure or is an external component of the structure, forms an outer skin of the pocket, wherein the interior of the pocket is accessible via a closable opening.

6. The item of clothing according to claim 2, wherein the air-flow opening leading to the environment is provided at a lower end of the pocket.

7. The item of clothing according to claim 2, wherein the air-flow opening leading to the environment is closed with an open-mesh woven netting fabric.

8. The item of clothing according to claim 2, wherein the opening of the pocket is closable via a zip fastener, a hook and loop fastener or a snap fastener.

9. The item of clothing according to claim 1, wherein the pocket provides a portion consisting of a transparent material, which allows visual access to the interior of the pocket.

10. Item of clothing according to claim 1, wherein the pocket provides an operating opening leading into the interior of the pocket for operation of a fitted air-pumping device.

11. The item of clothing according to claim 1, wherein the pocket is lined at least in portions or provides an internal casing.

12. The item of clothing according to claim 2, wherein a supporting insert preventing closure of the air-flow opening is provided in the region of the air-flow opening leading to the structure.

13. The item of clothing according to claim 2, wherein at least in the region of the air-flow openings, the layer limiting the pocket on an inside contacts an air-pumping device which is fitted in a sealing manner.

14. The item of clothing according to claim 13, wherein the layer contacts the air-pumping device substantially over its full surface area.

15. The item of clothing according to claim 2, wherein the opening is closed via a sealing closure means.

16. Item of clothing according to claim 1, wherein means for adjusting width of the item of clothing are a drawstring and/or at least one zip fastener releasing an expandable fabric-layer insert.

17. Item of clothing according to claim 3, wherein at least one further attachment position for a detachable pocket is provided, comprising the air-flow opening in an external layer tightly sealed via a removable layer portion.

18. The item of clothing according to claim 15, wherein the sealing closure means is a sealing zip fastener or a hook and loop fastener.

* * * * *

UNITED STATES PATENT AND TRADEMARK OFFICE

CERTIFICATE OF CORRECTION

PATENT NO. : 8,082,596 B2
APPLICATION NO. : 12/518534
DATED : December 27, 2011
INVENTOR(S) : Pohr et al.

It is certified that error appears in the above-identified patent and that said Letters Patent is hereby corrected as shown below:

On the Title page, Item (86) PCT filing date should read:
December 14, 2007

Signed and Sealed this
Twenty-eighth Day of February, 2012

David J. Kappos

David J. Kappos
*Director of the United States Patent and Trademark Office*